US005567247A

United States Patent [19]

Hawes et al.

[11] Patent Number: 5,567,247

[45] Date of Patent: Oct. 22, 1996

[54] METHOD FOR CLEANING OUTDOOR PAINTED/ARTIFICIALLY STAINED SURFACE

[75] Inventors: Charles Hawes, Summerville; Mark Thompson, Charleston, both of S.C.

[73] Assignee: Armor All Products Corporation, Aliso Viejo, Calif.

[21] Appl. No.: 514,245

[22] Filed: Aug. 11, 1995

Related U.S. Application Data

[63] Continuation-in-part of Ser. No. 383,769, Feb. 3, 1995.

[51] Int. Cl.[6] ..... C11D 3/08; C11D 3/395; C11D 7/56; C11D 7/16

[52] U.S. Cl. ..... 134/36; 510/240; 510/245; 510/370; 510/405; 239/310

[58] Field of Search ..... 252/94, 531, 135, 252/550, 187.24, 187.25, 187.26, 173, 187.27; 134/36; 239/310

[56] References Cited

U.S. PATENT DOCUMENTS

| | | | |
|---|---|---|---|
| 2,646,063 | 7/1953 | Hayes | 137/218 |
| 3,104,813 | 9/1963 | Baatrup | 236/102 |
| 3,104,825 | 9/1963 | Hayes | 239/407 |
| 3,106,347 | 10/1963 | Hayes | 239/505 |
| 3,181,797 | 5/1965 | Hayes | 239/317 |
| 3,201,049 | 8/1965 | Hayes | 239/433 |
| 3,381,899 | 5/1968 | Forsman | 239/317 |
| 4,057,505 | 11/1977 | Nakagawa et al. | 252/96 |
| 4,071,463 | 1/1978 | Steinhauer | 252/103 |
| 4,113,645 | 9/1978 | DeSimone | 252/187.4 |
| 4,116,851 | 9/1978 | Rupe et al. | 252/103 |
| 4,570,856 | 2/1986 | Groth et al. | 239/310 |
| 4,789,495 | 12/1988 | Cahall et al. | 252/95 |
| 4,806,263 | 2/1989 | Leathers et al. | 252/106 |
| 5,039,016 | 8/1991 | Gunzel, Jr. et al. | 239/314 |
| 5,100,059 | 3/1992 | Englhard et al. | 239/310 |
| 5,213,265 | 5/1993 | Englhard et al. | 239/310 |
| 5,223,168 | 6/1993 | Holt | 252/142 |
| 5,290,470 | 3/1994 | Dutcher | 252/102 |
| 5,383,603 | 1/1995 | Englhard et al. | 239/314 |

OTHER PUBLICATIONS

*BIX Exterior House Washer*, Manufactured by BIX Products Group, Inc., Old Hickory, TN 37138, Printed in U.S.A. Product No. 2700.

Brochure for *E–Z Vinyl Wash*, Manufactured by Armor All Home Care, Div. Armor All Products Corp., Memphis, TN 38138.

*Primary Examiner*—Paul Lieberman
*Assistant Examiner*—Gregory R. Delcotto
*Attorney, Agent, or Firm*—Burns, Doane, Swecker & Mathis, L.L.P.

[57] ABSTRACT

A concentrated cleaning composition for cleaning outdoor painted/stained surfaces. The concentrated cleaning solution includes an aqueous chlorinated bleach solution, a surfactant, a phosphate and a silicate. The concentrated cleaning solution is diluted with water to form a diluted composition which is applied to the surfaces to be cleaned to effect loosening of soil. Thereafter, the loosened soil is removed by the mechanical action of a water spray.

17 Claims, 3 Drawing Sheets

METHOD FOR CLEANING OUTDOOR PAINTED/ARTIFICIALLY STAINED SURFACE

This is a Continuation-In-Part of commonly-owned U.S. patent application Ser. No. 08/383,769, filed Feb. 3, 1995, now abandoned.

FIELD OF THE INVENTION

The present invention relates to a cleaning composition and method of use thereof, and more particularly, to a composition and method for cleaning mold, mildew, algae, grease, and stains from a variety of outdoor painted or stained surfaces.

BACKGROUND OF THE INVENTION

Current methods for the cleaning of homes vary from scrubbing with common household detergents to professional pressure cleaning. Although effective, the scrubbing procedures are very labor intensive due to the large surface area involved and can require the use of ladders as well as climbing on top of roofs for two story homes. Professional cleaning is inconvenient and costly.

There are products currently on the market which are considered scrub-free but are based on a special high pressure hose fitted nozzle which produces a very narrow blast of water with siphoned detergents. Most of the soil removing is accomplished due to the force of the water impacting against the soil. This type of system is very time consuming due to the narrow water blast and large surface area involved. It can be ineffective in removing some biological soils such as algae and mold.

Another non-scrub cleaner on the market applies chlorine bleach to the surface in high concentration from a pump-up sprayer. The action of the chlorine attacks and dissolves the biological soils followed by a rinse. Virtually all of the soil removal is accomplished from the cleaner and the rinse plays a minor role. Again the operation is time consuming due to the length of time it takes to apply the cleaner from a pump up sprayer and use of ladders and roof climbing is often required to reach all of the surface.

Numerous cleaning products are currently known for cleaning different types of surfaces such as wood, plastic and metal, which are exposed to the outdoor environment. These materials are used in making decks, fencing, siding and so forth, and each presents unique problems with respect to cleaning. The known products usually require some type of scrubbing or brushing in order to achieve the stated purpose. Further, many of these products require mixing or measuring of some sort and therefore are very susceptible to being mixed improperly thus rendering them ineffective or an environmental and safety hazard. Many of the products also harm plants, fish, animals, or birds, and such products can destroy the landscaping and/or wildlife around the structure being cleaned.

The need for universal, or at least multiple surface compatibility is most relevant in applications where a surface to be cleaned comprises but a part of an overall structure, and where constraints of time and effort discourage a careful confining of the cleaning solution exclusively to the soiled surface.

An example of this is the cleaning of outdoor painted or stained surfaces on a house. Typically such surfaces are interrupted by window and door frames comprised of aluminum, steel and/or wood. The cleaning solution should function effectively without harm to such surrounding other materials. This would enable a blanket application of the solution over a large area in a short amount of time. It would also be desirable to apply via spraying a cleaning solution on the upper portions of a house otherwise unreachable without using a ladder. Also, the cleaning solution should remove soil without brushing or scrubbing. This is highly desirable, again, on the upper portions of a house.

As a cleaning solution, chlorine bleach is known to remove mold, mildew and other organic and inorganic soil from outdoor surfaces. However, chlorine bleach, standing alone, corrodes metal and hence would be unsuitable in blanket applications such as outdoor surfaces on houses with metal window and door frames. Bleach without a surfactant can spread unevenly and stain wood surfaces.

Various cleaning compositions which incorporate an aqueous bleach component are disclosed in U.S. Pat. Nos. 4,057,505; 4,071,463; 4,113,645; 4,116,851; 4,789,495; and 4,806,263. The '505 patent incorporates a synthetic alcohol sulfate surface active agent and 0.05 to 2% (as used herein, % refers to wt. % unless otherwise indicated) alkali stabilizer such as sodium hydroxide, sodium carbonate or sodium orthophosphate in an aqueous solution of 3 to 7% alkali metal hypochlorite for laundry cleaning purposes. The '463 patent acknowledges the problem of lack of stability when ingredients are combined with hypochlorite bleaches. In addition, the '463 patent incorporates an alkali metal alkyl sulfate, an alkylated diphenyl oxide sulfonic acid alkali metal salt such as sodium dodecyl diphenyl oxide disulfonate ("DOWFAX 2A1"), a branched chain alkyl aryl sulfonate or mixtures thereof in an aqueous solution of 0.25 to 1.0% sodium hypochlorite with an alkaline builder such as sodium carbonate, trisodium phosphate, sodium metasilicate or sodium hydroxide to maintain the pH above 11.0. The '645 patent discloses a perfumed 1 to 15% hypochlorite bleach composition which is stable over long periods of time by utilizing perfume oils resistant to the oxidative effects of the bleach. The '851 patent incorporates up to 15% of a builder, up to 10% of a surfactant, 0.25 to 20% of a thickening agent and 0.5 to 9% of an alkali metal silicate such as sodium silicate in a 1 to 10% aqueous solution of sodium hypochlorite used for cleaning kitchen utensils. The '495 patent discloses a cleaner for tiles, porcelain, floors, drains and laundry which incorporates 0.1 to 3% of a tertiary alcohol, a 0.5 to 7% of a hypochlorite-compatible surfactant, and up to 10% of an alkali metal hydroxide, an optional sodium silicate corrosion inhibiter in an aqueous solution of 0.5 to 10% sodium hypochlorite having a pH above 10 and shelf stability of at least three months. The '263 patent discloses a cleaner for solid surfaces which can be applied by a sprayer and which incorporates 0.003 to 0.4% of a water insoluble fungicide, algicide or mixture thereof, 1.0 to 6.0% detergent, 3 to 10% of a pH adjuster such as boric acid to adjust the pH to 4.0 to 8.5 prior to addition of an oxidizing agent, a thickener, and up to 1.0% of a chelating/sequestering agent such as sodium tripolyphosphate or trisodium phosphate in an aqueous solution of 5.25% sodium hypochlorite.

Although the foregoing patents disclose aqueous solutions of sodium hypochlorite for various cleaning purposes, these patents do not specifically address the need for a cleaner which removes foreign matter such as mold, mildew, algae, grime, pollen, pollution, etc., which build up on painted outdoor surfaces. Moreover, these patents do not address the need for a cleaner which is biodegradable and which does not attack exposed glass and metal surfaces on such buildings.

There is hence a need in the art for a cleaning solution which functions effectively in cleaning painted/stained surfaces such as wood, brick, concrete, etc., and which can be used effectively in blanket applications without worry of damage to adjacent metal or wood and glass surfaces. There is also a need in the art for a cleaning solution which is effective without the need for brushing and scrubbing to remove soil.

SUMMARY OF THE INVENTION

The invention provides a concentrated cleaning composition useful for cleaning solid outdoor painted/stained surfaces by diluting and spraying the cleaning composition onto surfaces to be cleaned followed by rinsing the surfaces with water, the concentrated cleaning composition consisting essentially of an aqueous chlorinated bleach solution, the concentrated cleaning solution having hypochlorite content of 3–10%, the concentrated cleaning solution further comprising a surfactant in an amount effective for wetting of the soiled surface, penetration into the soil and minimize destabilization of available chlorine in the bleach solution; a phosphate in an amount effective for stabilizing the available chlorine in the bleach solution by maintaining the pH of the bleach solution at a level which retards oxidation of the available chlorine; and a silicate in an amount effective for protecting metal and/or glass surfaces which come into contact with the cleaning composition.

According to a preferred embodiment of the invention, the bleach can be an alkali metal hypochlorite such as sodium hypochlorite. The silicate can comprise sodium silicate such as sodium metasilicate having a Na:Si ratio of about 1:1 to about 1:3 and the sodium silicate can be present in an amount of at least 0.05% and up to about 0.25%. The surfactant can be a sulfonated and/or sulfated surfactant and the surfactant can be present in an amount of about 0.10 to about 2.5%. The phosphate can be trisodium phosphate and the phosphate can be present in an amount of about 0.5 to about 5.0%. The cleaning composition can optionally include a fragrance and/or a defoamer. The concentrated cleaning composition is preferably free of fragrance, free of defoamer, free of alcohol and contains over 90% water.

The invention also provides a diluted cleaning composition useful for cleaning soiled outdoor painted/stained surfaces by spraying the diluted cleaning composition onto painted/stained surfaces to be cleaned followed by rinsing the surfaces with water, the diluted cleaning consisting essentially of a chlorinated aqueous bleach solution having a hypochlorite content of 0.10 to about 2.0%, the diluted cleaning solution further including less than 0.5% of a surfactant, the surfactant being present in an amount effective for wetting of the painted/stained surface and penetration into the soil; a phosphate in an amount effective for water softening; and a silicate in an amount effective for protecting metal and/or glass surfaces which come into contact with the cleaning composition. The bleach can be an alkali metal hypochlorite such as sodium and/or potassium hypochlorite. The silicate can comprise an alkali metal silicate such as sodium silicate (e.g., sodium metasilicate) having a Na:Si ratio of about 1:1 to about 1:3 and the sodium silicate can be present in an amount of about 0.005 to about 0.05%. The phosphate can be alkali metal phosphate such as trisodium phosphate and the phosphate can be present in an amount of about 0.05 to about 1.0%. The surfactant can be a sulfonated and/or sulfated surfactant and the surfactant can be present in an amount of 0.01 to 0.3%.

The invention provides a method for cleaning material such as mold, mildew, algae, and/or dirt from a soiled outdoor painted/stained surface, comprising the steps of forming a diluted cleaning composition by feeding a concentrated cleaning composition and water into a mixing chamber of a spray gun; spraying the diluted cleaning composition from the spray gun onto a surface to be cleaned; allowing the diluted cleaning composition to remain on the surface to be cleaned for a period of time sufficient to loosen material to be removed from the surface to be cleaned; and removing the loosened material and diluted cleaning composition from the surface to be cleaned by spraying rinsing water onto the surface to be cleaned.

According to a preferred embodiment of the method, the water is fed into the mixing chamber through a first inlet in the spray gun, the concentrated cleaning composition is fed into the mixing chamber through a second inlet in the spray gun and the diluted cleaning composition and/or the rinsing water are sprayed from the spray gun through at least one outlet in the spray gun. The at least one outlet can comprise first and second outlets to allow the diluted cleaning composition to be sprayed only from the first outlet and the rinsing water to be sprayed only from the second outlet. Water is mixed with the concentrated cleaning composition to reduce the concentrated cleaning composition by 5 to 15, preferably about 10 times during the step of forming the diluted cleaning composition. The diluted cleaning composition can be sprayed from the spray gun at a first flow rate and the rinsing water can be sprayed from the spray gun at a second flow rate, the second flow rate being at least two times greater than the first flow rate. The diluted cleaning composition can be sprayed from the spray gun in a first pattern and the rinsing water can be sprayed from the spray gun in a second pattern, the second pattern being smaller and at a higher velocity than the first pattern. The velocity of the water in the rinsing step can be from about five meters per second to about 30 meters per second and the volume of water applied to the surface in the rinsing step can be from about 1 to about 10 liters per square meter of surface.

The invention also provides a spray gun for cleaning a soiled outdoor painted/stained surface, the spray gun comprising a first inlet attachable to a hose for supplying water to the spray gun; a second inlet for supplying a concentrated cleaning composition to the spray gun; a mixing chamber in fluid communication with the first and second inlets and wherein a diluted cleaning composition is formed by feeding water through the first inlet and feeding a concentrated cleaning composition through the second inlet; a first outlet for spraying the diluted cleaning composition from the spray gun onto a surface to be cleaned; a second outlet for spraying rinsing water from the spray gun to allow removal of the diluted cleaning composition from the surface to be cleaned by spraying rinsing water from the spray gun onto the surface to be cleaned; and valve means for selectively feeding the diluted cleaning composition to the first outlet or feeding only rinsing water to the second outlet.

According to a preferred embodiment of the spray gun, the concentrated cleaning composition can be an aqueous bleach solution and the spray gun can include means for diluting the aqueous bleach solution with the water by an amount of 5:1 to 15:1. The spray gun can include means for spraying the diluted cleaning composition from the spray gun at a first flow rate and means for spraying the rinsing water from the spray gun at a second flow rate, the second flow rate being greater (e.g., at least two times greater) than the first flow rate. The spray gun can include a container of the concentrated cleaning composition, the container being attached to the spray gun and the spray gun including a siphoning tube extending into the container, the second inlet being in fluid communication with the siphoning tube and the concentrated cleaning composition being removed from the container by feeding the water through the mixing chamber and siphoning the concentrated cleaning composition from the container. The spray gun can also include means for spraying the diluted cleaning composition from the spray gun in a first pattern and means for spraying the rinsing water from the spray gun in a second pattern, the second pattern being smaller than the first pattern.

DETAILED DESCRIPTION OF THE PREFERRED EMBODIMENTS

Figure 1:
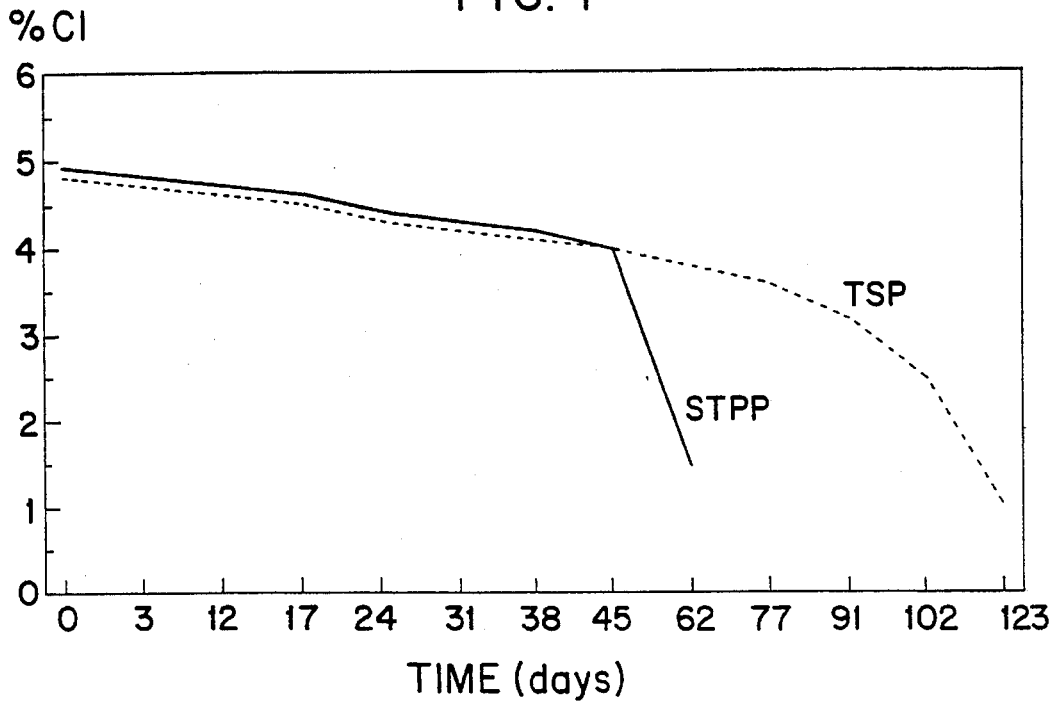
FIG. 1 is a graph showing effects of TSP and TSPP on loss of Cl versus time.

One object of the invention is to provide a cleaning composition which is convenient to use yet provides effective cleaning of soiled outdoor painted surfaces such as wood, concrete, brick, etc., or paint-like stained wood surfaces without damage to the surrounding environment. For instance, the cleaning composition does not attack and/or corrode surrounding metal and/or glass surfaces and can be rinsed from the outdoor painted/stained surfaces without harm to adjacent plant and/or animal life.

The cleaning composition according to the invention is an aqueous chlorinated bleach solution containing a surfactant in an amount effective for complete wetting of the painted/stained surface, penetration into the soil and minimize destabilization of the available chlorine in the bleach solution. The cleaning composition can also contain a phosphate in an amount effective for stabilizing the available chlorine in the bleach solution by maintaining the pH of the bleach solution at a level which retards oxidation of the available chlorine. Moreover, a silicate can be incorporated in the cleaning composition in an amount effective for protecting metal and/or glass surfaces which come into contact with the bleach solution by forming a molecular film on the metal and glass surfaces.

The silicate and phosphate are preferably added together since the phosphate reduces the adverse effects of hard water on the silicate and the surfactant. Further, since bleach degrades over time and produces acid thus lowering the pH of the cleaning composition and the bleach degrades very rapidly when the pH of the cleaning composition lowers to about 10, a phosphate can be added to the cleaning solution for purposes of taking up acids and thus prolonging the life of the bleach solution.

The cleaning composition can include a surfactant to help spread the cleaning composition over the surface or surfaces to be cleaned. For instance, the surfactant can comprise a sulfonated surfactant such as "DOWFAX 2A1" (sodium dodecyl diphenyloxide disulfonate) sold by DOW Chemical Co. The surfactant acts as a wetting agent which aids water in spreading over the surface to be cleaned and/or penetration of the bleaching agent through soil to be removed from the surface to be cleaned.

The cleaning composition can include a silicate to protect metal surfaces such as aluminum. The silicate should be present in an amount sufficient to protect metal surfaces but below an amount which can attack (e.g., etch) the metal or surrounding glass surfaces and/or form a deposit on such surfaces which is difficult to remove. A preferred silicate is sodium metasilicate. In situations where the cleaning solution is mixed with hard water, it is advantageous to also include a phosphate water softening agent such as TSP (trisodium phosphate) and/or STPP (sodium tripolyphosphate). Otherwise, the sodium metasilicate would react with the hard water and the effectiveness of the sodium metasilicate in protecting the metal surfaces would be lowered.

The silicate provides protection of glass and/or aluminum surfaces which come into contact with the cleaning composition. An especially preferred silicate is an alkali silicate such as sodium silicate ($Na_2O{\cdot}SiO_2$) since sodium silicate forms a protective molecular film on aluminum surfaces. On the other hand, calcium silicate is not effective in protecting aluminum surfaces. The Na:Si ratio preferably ranges from 1:1 to 1:3 since such ratios are effective in providing a molecular SiO film on aluminum. The content of the silicate in the cleaning solution preferably provides the protective SiO film but avoids staining of metal and glass surfaces. Surprisingly, as little as 0.1% sodium silicate in the concentrated cleaning composition has been found to provide adequate film forming properties whereas amounts greater than 0.5% may cause silicate staining of glass and/or metal surfaces.

The cleaning composition can be used in a variety of ways. For instance, the cleaning composition can be in a concentrated form and a hand-held portable spray gun attached to a container of the concentrated cleaning composition can be used to dilute and apply the cleaning composition to a surface to be cleaned. The spray gun can include an inlet port attached to a garden hose for supplying pressurized water and at least one outlet port for spraying the diluted cleaned composition onto the surface to be cleaned or spraying only water to rinse the surface to be cleaned.

The diluted cleaning composition can be sprayed onto an outside wall structure, allowed to remain on the wall for a period of time (e.g., 10 minutes) sufficient to loosen the soil to be removed and subsequently the loosened soil can be mechanically blasted from the wall due to the force of the water spray impacting against the loosened soil. Thus, a very weak cleaning solution can be used which is not detrimental to the surrounding environment.

In order to provide the greatest ease of application of the cleaning composition and/or rinsing of the surface to be cleaned, the spray gun preferably sprays a pattern of diluted cleaning composition or jet of only water a distance sufficient to reach at least a first floor and even up to a second story of a house or building to be cleaned. Such distances will be achievable if the water pressure is sufficient.

The invention overcomes the ineffectiveness and/or inefficiencies of the practices and products currently on the market. Specifically, the invention is a do-it-yourself cleaning system that combines the effectiveness of chlorine bleach with the efficiency of a hose-end sprayer. This results in a non-scrub cleaning system where the soil removal comes from a combination of chemical attack of the chlorine on the soil which weakens its bond to the painted/stained surface followed by a rinse with enough force to remove the weakened soil.

The effectiveness and efficiency of the inventive wash system for the removal of difficult soils comes from the contribution of both the diluted cleaner and the force of rinse in such a way that 1) an exceptionally strong concentrate is not needed so that the efficiency of a hose-end sprayer can be used which by its nature dilutes and thereby weakens the cleaner and 2) an exceptionally strong rinse force is not needed so that the pressures usually available to the consumer will provide an adequate force against the preweak-end soil in order to remove it. This system is intended to be safe for plants, animals and non-corrosive to the skin or eyes.

The sprayer is designed to reach up to 20 feet high which is necessary for two-story homes thereby minimizing and often eliminating the need for ladders and unsafe climbing onto roofs. Considerable work has been done in order to establish chlorine stability to the liquid cleaner formula so that the performance of the product is maintained for a length of time (e.g., at least three months) beyond that which the product would normally be used after purchase by the consumer. The formulation is designed not to damage other building materials that would normally be in the immediate vicinity of the painted/stained surface such as glass, aluminum and galvanized steel.

In developing the invention, a soil study was conducted in order to classify the different types of soils likely to be found on outdoor vinyl surfaces. All soils found were identified only to the extent as necessary for picking and choosing active ingredients that have the potential to remove the soil by the corresponding mechanism. In all cases a visual inspection was made which in most cases identified the soil. For example, a green soil was considered to be algae due to the color alone. In those cases where an identification could not be concluded from visual inspection an identification was not made if the soil was easily removed. An example was a soil with black color which could not be distinguished from roof asphalt. In that case it was determined that in cases where chlorine bleach would turn it colorless the soil was classified as mold/mildew (biological) and if the bleach had no effect such as at locations near the roof, the soil was presumed to be asphalt. The identification of rust stains were determined in a similar manner. No major soil was encountered where it was found necessary to identify the soil in a more precise and scientific way in order to find a cleaning solution to remove it. The soil study was conducted in N. Carolina, S. Carolina, Texas, Florida and Arizona.

The following soils were found on vinyl siding in this study:

Green Algae
Black Mold/Mildew
Silicate based dirt
Roof Asphalt
Bird Droppings
Spider Webs As a first step in the design of an effective dilutable concentrated cleaning solution, screen tests were conducted with individual classes of chemicals in order to sort out those items quickly that do not perform even in the concentrated form. Samples of vinyl siding were removed from a home in Burlington, N.C. for use in this and other preliminary testing. The results of these screen tests are shown below:

| | |
|---|---|
| Visual Cleaning Rating | 0 = Complete soil removal<br>1 = Some slight soil remained<br>2 = Half of soil remained<br>3 = No soil removed |

Each of the solvents listed below was placed on a soiled piece of vinyl, allowed to set 10 minutes and followed by a rinse with soft tap water delivered from a spray bottle.

| Solvent | Cleaning Result |
|---|---|
| Ethylene Glycol Monobutyl Ether | 3 |
| Propylene Glycol Monomethyl Ether | 3 |
| d-limonene | 3 |
| N- methyl pyrrolidone | 1 |
| G- butryo-lactone | 2 |
| monoethanolamine 99% | 3 |
| Propylene Glycol tert-Butyl Ether | 3 |
| mineral spirits | 3 |
| Xylene | 2 |
| Dimethyl Glutarate | 3 |
| Dimethyl Adipate | 3 |
| Dimethyl Succinate | 3 |
| Benzyl Alcohol | 3 |
| o-Dichloro Benzene | 2 |
| Nitro propane | 3 |

Of the various solvents tested only N-methyl pyrrolidone was considered a potential candidate. A simple formula was put together as follows with the corresponding cleaning result:

| | |
|---|---|
| 94.90% | Water |
| 5.00% | N-methyl Pyrrolidone |
| 0.10% | Igepal CO-630 Surfactant |
| | Cleaning Result = 3 |

Although somewhat effective in the concentrated form, when this cleaning formula was diluted 20 times with water the N-methyl pyrrolidone was ineffective in the removal of the major soils.

Various acids and alkali substances were tested in the concentrated form and were basically found to be effective according to the substances hazard character (i.e., the more hazardous, the more effective). These substances where therefore tested at a dilution in water below or just at 1% since it was an objective of this invention to develop a non-hazardous product. Results of the tests are shown as follows:

General Formula
98.9% Water
1.0% Acid or Alkali
0.2% Igepal CO-630 Surfactant

| Substance | Cleaning Result |
|---|---|
| Sulfuric Acid | 3 |
| Nitric Acid | 3 |
| Phosphoric Acid | 3 |
| Hydrochloric Acid | 3 |
| Citric Acid | 3 |
| Glycolic Acid | 3 |
| Sodium Hydroxide | 2 |
| Ammonium Hydroxide | 3 |
| Sodium Carbonate | 3 |

As can be seen from the above results, none of the substances was found to be effective.

The following oxidizers and reducing bleaches were tested at a concentration of 1%. The results are shown below.

| General Formula<br>98.9% Water<br>1.0% Oxidizer or reducer<br>0.2% Igepal CO-630 Surfactant | |
|---|---|
| Substance | Cleaning Result |
| Sodium Percarbonate | 3 |
| Sodium Perborate | 3 |
| Sodium Persulfate | 3 |
| Sodium Peroxysulfate | 3 |
| Sodium Meta Bisulfate | 3 |
| Sodium Hydrosulfite | 3 |
| Hydrogen Peroxide | 3 |
| Sodium Hypochlorite | 0 |
| Sodium Sulfite | 3 |

The following results show that of the above listed substances only sodium hypochlorite has potential as an active ingredient in order to remove the difficult biological soils without scrubbing. The tests were carried out by applying the test solutions, allowing to set 10 minutes followed by a water rinse. The following are test results whereby the active chlorine level was varied from 1% and below in order to establish the minimum chlorine level required to remove the more difficult to remove biological soils.

| % Sodium Hypochlorite + 0.1% Dowfax 2A-1 + bal water | Cleaning Result |
|---|---|
| 1.0% | 0 |
| 0.5% | 0 |
| 0.25% | 0 |
| 0.20% | 0 |
| 0.15% | 1 |
| 0.10% | 1–2 |
| 0.05% | 3 |

The above results show an optimum range of chlorine for removal of biological soil consisting mainly of algae with some mold on samples of vinyl obtained from a home in North Carolina which had a high soil load.

Homes selected with vinyl siding with high soil loads in Texas, Florida, Arizona, North and South Carolina were test cleaned with a solution containing 98.0% of a 5.25% sodium hypochlorite aqueous solution and 2.0% of DOWFAX 2A1 using a sprayer with a 32:1 water to product ratio. The homes were cleaned in a single application.

It was concluded that a product containing a sodium hypochlorite level of about 5% in water with a small amount of surfactant would suffice to clean better than average dirty homes around the country when using a Green Garden K-1 sprayer that delivers the formula diluted 20:1 with water.

Common substrates which are in the vicinity of vinyl siding on homes are glass and aluminum from windows and aluminum and galvanized steel from gutters. These three substrates were tested for corrosion effects from the vinyl wash solution described above. Aluminum was found to be adversely affected. A darkening of the metal was found to occur within a minute of contact time in the concentrated form. In the 20:1 diluted form, some effect could still be seen if allowed to dry. Sodium metasilicate pentahydrate was tested to determine its corrosion prevention potential. High levels of the sodium silicate were found to have an adverse effect on glass. Also, it was determined that an addition of a small amount of chlorine stable chelating agent or water softener was advantageous for counteracting the effects of hard water in some parts of the country. Absence of a water softener in such areas can result in deactivation or weakening of the surfactant and the silicate. Two preferred chlorine stable water softeners are sodium tripolyphosphate and trisodium phosphate. Trisodium phosphate was found to perform better than sodium tripolyphosphate due to a stabilizing buffering effect on the chlorine.

The stability of sodium hypochlorite solutions is important for purposes of providing adequate shelf life of the cleaning solution according to the invention. Stability studies were carried out to cause accelerated aging by heating the solution containing the sodium hypochlorite at elevated temperature and measuring the loss of available chlorine. This method is used as a technique to compare the various ingredients needed in the formulation. Using this method, several surfactants, builders, corrosion inhibitors and fragrances were discovered which have the best long term stability with chlorine in the cleaning composition according to the invention. These findings are listed below:

Of the surfactants tested for chlorine stability, the following anionic surfactants were found suitable for the vinyl wash formulation based on compatibility with chlorine and wetting power:

Mono and Dialkyl diphenyl oxide disulfonates—Typical examples are the DOWFAX Surfactants, a trade name of the Dow Chemical Co.

Sodium Lauryl Sulfate—A typical example is STEPANOL WAC, a trade name of the Stepan Co.

Sodium Dodecylbenzenesulfonate—A typical example is the neutralized form of BIOSOFT S-100, a trade name of the Stepan Co.

Figure 2:
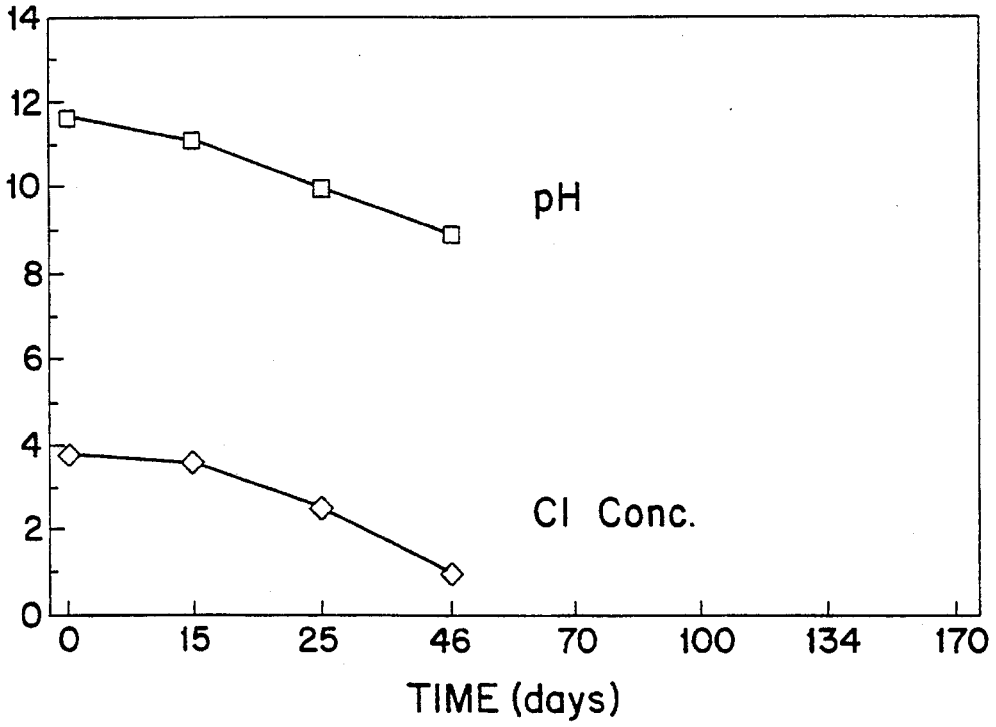
FIG. 2 is a graph showing a correlation of pH loss and Cl loss versus time.

Of the builders tested, it was found that sodium pyrophosphate is incompatible with the high sodium content of the standard 5.25% sodium hypochlorite solution used in the vinyl wash formulation. Two phosphates which have been successfully used for this application are sodium tripolyphosphate and trisodium phosphate. While both work well to counter the water hardness effect, trisodium phosphate was found to have an advantage over the tripolyphosphate in its alkaline buffering character, as shown in FIG. 1. This buffering effect which absorbs acids produced by the degradation products produced by the attack of chlorine on the surfactant and any other organics in the formula, slows the rate of pH reduction and thus slows the rate of Cl loss. For instance, as shown in FIG. 2, the pH of the hypochlorite solution drops as the Cl level decreases and the rate of Cl loss increases rapidly when the pH falls below 10.

Preferred Formulations of the inventive concentrated cleaning composition (herein referred to as "Vinyl Siding Wash") are as follows:

| Ingredients (in weight %) | A | B | C |
|---|---|---|---|
| 5.25% Sodium Hypochlorite Solution | 96.75 | 96.75 | 96.55 |
| Trisodium phosphate (TSP) | 1.00 | — | — |
| Sodium Metasilicate Pentahydrate | 0.25 | 0.25 | 0.25 |
| DOWFAX 2A1 | 2.00 | 2.00 | 2.00 |
| Sodium Tripolyphosphate (STPP) | | 1.00 | 1.00 |
| fragrance | — | — | 0.20 |

Figure 3:
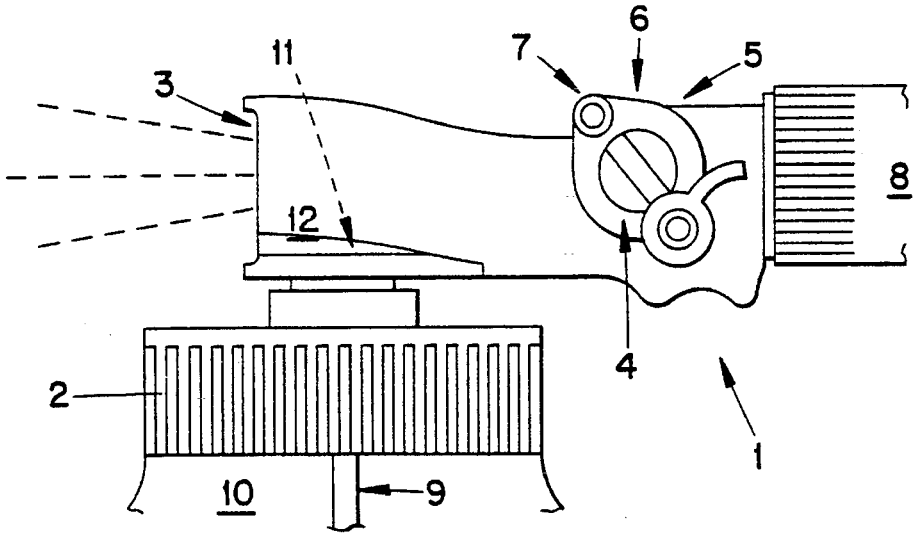
FIG. 3 shows a prior art sprayer which can be used to apply the diluted cleaning solution in accordance with the invention.

The Vinyl Siding Wash can be applied with a suitable spray gun such as a sprayer sold by Green Garden Inc., of Somerset, Pennsylvania. This type of sprayer is known as Green Garden's K-1 Sprayer, Model No. 103-B. As shown in FIG. 3, the sprayer 1 can be provided with a 70 mm connector as opposed to the standard 28 mm connector. The sprayer can be included in a Vinyl Siding Wash Kit. The sprayer has two roles: it is used to dilute and apply Vinyl Siding Wash Concentrate to exterior vinyl siding and again to remove stains and soils loosened by the cleaner using forceful rinsing. The K-1 accomplishes this with one exit hole 3 that delivers one spray pattern.

This particular sprayer applies and removes the product using a 3-position selector 4 which has an "on" position 5, a "water only" position 6 and an "off" position 7. When attached to a garden hose 8, the sprayer can deliver a stream of diluted mixture of product, a stream of water for rinsing, or be completely turned off. In the "on" position, when dilution is occurring, a pick-up tube 9 serves as a basic siphon. This tube 9 is dipped into the product bottle 10 and the entire sprayer is fastened to the bottle. The siphon, known as an aspirator, is created when flowing water passes over a depression/hole 11 in the bottom of a mixing chamber 12 of the sprayer. A vacuum forms at the top of this hole opening which draws the product upward through the pick-up tube and into the passing water stream where it is diluted/mixed. The resulting product to water ratio delivered by the current model 103-B sprayer typically falls in the range of 1:17 to 1:25. A ratio of 1:20 has been established as an ideal mixing ratio, but the product can be diluted as much as 1:25. Beyond this limit there is noticeable change in product performance as the dilution ratio becomes too large for effective cleaning. Of course, the optimum mixing ratio ultimately depends on the strength of the concentrated cleaning composition.

The volume of water being delivered by the K-1 sprayer provides acceptable rinsing power and range of distance for delivery of diluted product/rinsing water. However, a large volume of product may be drawn from the bottle while maintaining the required 1:20 ratio resulting in that the bottle is emptied quickly. This water volume/product volume relationship is directly proportional (i.e., as water volume increases so must product volume) and serves to define the efficiency of the sprayer in terms of product usage and conservation. Accordingly, other sprayer arrangements which optimize rinsing power, spray distance and conserve product can be used.

Figure 4:
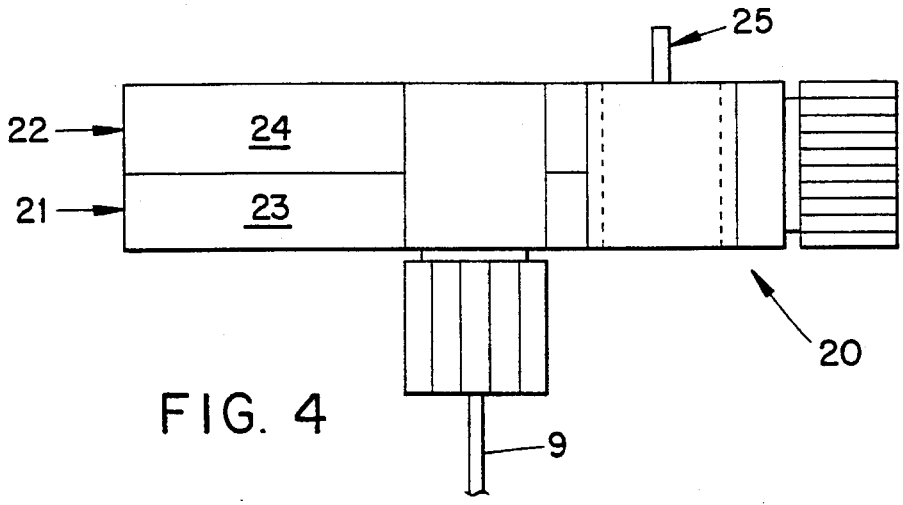
FIG. 4 shows a sprayer in accordance with the invention.
Figure 5:
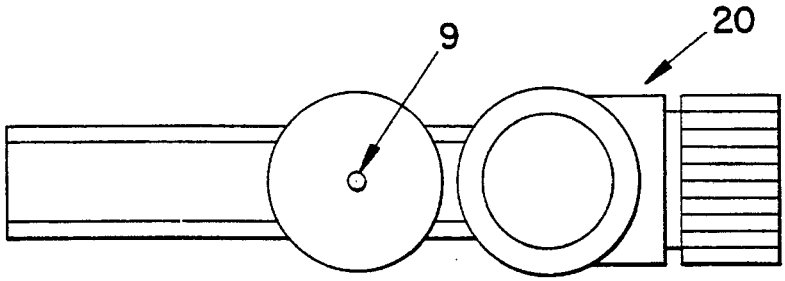
FIG. 5 is a bottom view of the sprayer shown in FIG. 4.
Figure 7:
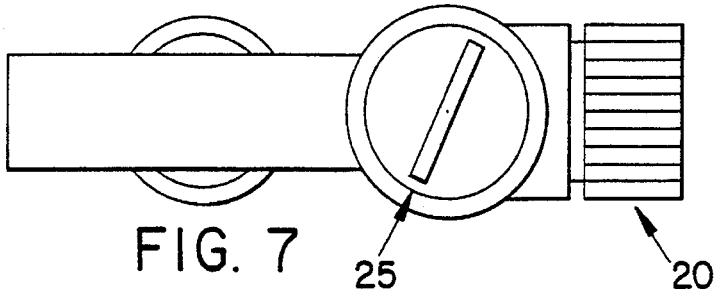
FIGS. 7 and 8 are top views of the sprayer shown in FIG. 4 with the selector in different positions.
Figure 8:
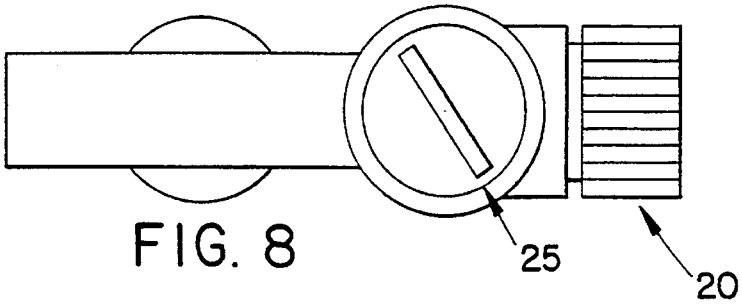
Figure 10:
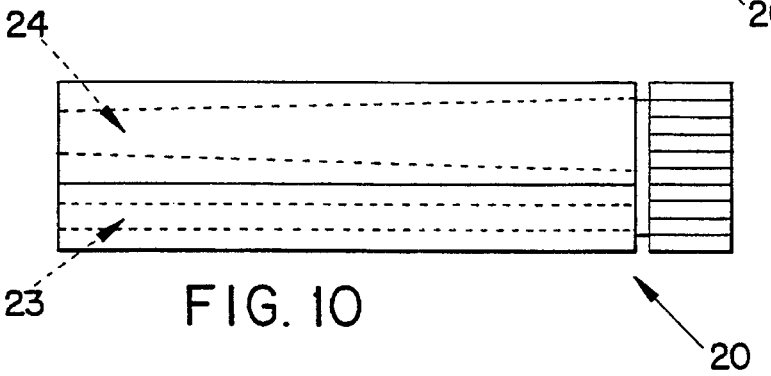
FIG. 10 shows details of a double-chamber arrangement of the sprayer shown in FIG. 4.
Figure 6:
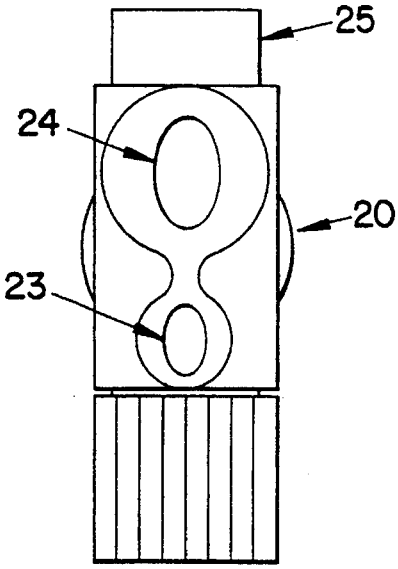
FIG. 6 is a front view of the sprayer shown in FIG. 4.
Figure 9A:
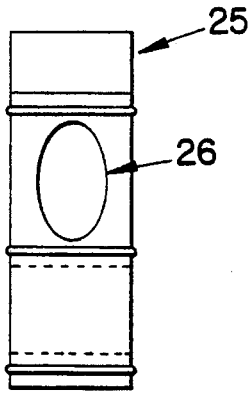
FIGS. 9*a* and 9*b* show details of the selector shown in FIG. 4.
Figure 9B:
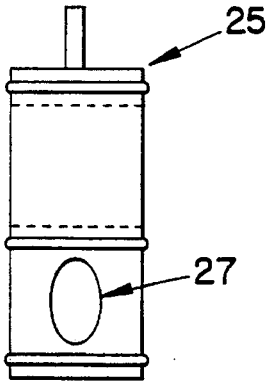

A sprayer 20 which achieves efficient use of product plus optimum rinsing power can include two distinct spray patterns (i.e., 2 exit holes), one 21 for applying Vinyl Siding Wash and another 22 for rinsing off, as shown in FIG. 4. This would allow the sprayer to function in two separate roles. Presently the K-1 sprayer delivers one fan-shaped pattern with a spread of approximately 3 feet at a distance of 6 feet. The sprayer 20 shown in FIG. 4 can be designed to provide an application pattern that is fan-shaped with a spread of two feet at a distance of six feet and provide a rinsing pattern in a more concentrated stream with a spread of about six inches at a six foot range. Further, the rinse-only exit hole 22 can be twice as large as the product exit hole 21 thus allowing for increased water volume depending on the selector position. For instance, if the water flow is channeled through mixing chamber 23, aspiration occurs and product can be applied in a similar volume and pattern as the K-1 sprayer (the exit holes can be shaped to produce any spray pattern desired). Moving the selector and channeling water through a water-only chamber 24 allows for a larger volume of water (no aspiration) in a narrowed spray pattern. This dual-role sprayer otherwise can include the same fitting, seals and connectors as the K-1 sprayer and would serve the need of having a rinsing function that is independent of the product application function.

Additional details of the dual chamber sprayer 20 are shown in FIGS. 5–10. The dual chamber sprayer 20 provides advantages over K-1 sprayer 1 in that the double-chamber configuration provides two independent sprayers in one housing, whereas the K-1 sprayer uses a single chamber which restricts the rinsing spray to the same volume and pattern as the application spray. The dual chamber sprayer 20 can include a selector 25 which contains two holes 26, 27 to direct water flow accordingly and an "off" position to stop water flow completely. The result is a new and improved sprayer which functions as a part of a cleaning system where the effectiveness of the product hinges on the performance of the sprayer.

Other sprayers can be used to apply a diluted cleaning solution onto vinyl, painted or stained outdoor surfaces in accordance with the invention. For instance, the sprayer can be of the type disclosed in commonly-assigned U.S. patent application Ser. No. 08/451,922, the disclosure of which is hereby incorporated by reference.

The following examples are given to illustrate various aspects of the invention.

EXAMPLE 1

Vinyl Siding Wash was tested to remove mold and mildew. Mold and mildew stains are superficial biological growths that are identical in appearance (black) and composition. Because of these similarities and the fact that these fungi are consistently found in the presence of one another, there exists no clear definition of the two. Their composition is often a complex combination of airborne bacteria, wild yeast and many other microorganisms, spores and bacteria. Many samples containing this type of soil were furnished from a site in Burlington, N.C.. These samples were heavily soiled under natural conditions ensuring the maximum adherence of these biological growths to the vinyl and support for the validity of laboratory tests.

Test Equipment/Materials:

9×12" heavily-soiled section of vinyl from N.C. home.
12 oz. spray bottle.
Green Garden Sprayer Apparatus.
50 ft. garden hose.

Method:

A 9×12" section of heavily-soiled vinyl siding recovered from a Burlington, N.C. home was treated with Vinyl Siding Wash delivered from a 12 oz. spray bottle at a dilution of 1:20. After 10 minutes, the sample was spray-rinsed with water using the Green Garden Sprayer Attachment at a distance of 4–6 feet. Vinyl Siding Wash showed excellent performance in the removal of mold and mildew with 100% soil removal.

EXAMPLE 2

Vinyl Siding Wash was tested to remove algae, a very tenacious growth common to vinyl siding. Algae is characterized by a green color and requires a moist environment to flourish. Consequently, algae is typically found on the shady side(s) of a vinyl-sided home where the lack of sunshine allows the siding to remain moist with dew, rain, etc., for extended periods of time. Vinyl siding samples soiled heavily with algae under these exacting conditions were removed from a house in Burlington, N.C. for use in this experiment.

Test Equipment/Materials:

9×12" heavily-soiled section of vinyl from N.C. home.
12 oz. spray bottle.
Green Garden Sprayer Apparatus.
50 ft. garden hose.

Method:

A 9×12" section of heavily-soiled vinyl siding recovered from a Burlington, N.C. home was treated with Vinyl Siding Wash delivered from a 12 oz. spray bottle at a dilution of 1:20. After 10 minutes, the sample was spray-rinsed with water using the Green Garden Sprayer Attachment at a distance of 4–6 feet. Vinyl Siding Wash showed excellent performance in the removal of algae with 100% soil removal.

EXAMPLE 3

Ordinary household detergents were tested compared to Vinyl Siding Wash in cleaning vinyl siding. Common household cleaners such as Tide, Dawn and Formula 409 are not designed for use on vinyl-sided homes and can leave a film on some exterior home surfaces. The basis of this experiment was to apply and remove these cleaners from exterior home surface materials in a similar manner to Vinyl Siding Wash (apply and rinse with water) and note any depositing of a residual film. The various external materials considered in this procedure were aluminum, glass and vinyl siding which represent the exterior home materials/surfaces commonly in direct contact with Vinyl Siding Wash. Although the length of contact time is usually very brief where Vinyl Siding Wash is concerned, Tide, Dawn, 409 and Vinyl Siding Wash were all allowed to dry completely on the surfaces before rinsing. This permitted the additional contact time between cleaner and surface required for the possible formation of a film. Solutions of Tide and Dawn were prepared at concentrations of 0.75%. This percentage is approximately equal to 1 ounce per gallon which represents a typical working strength for these cleaners.

Test Equipment/Materials:

3×6" Aluminum Panels.
3×3" PVC Vinyl Siding Panels.
4×12" Glass Panels.
22 oz. bottle of 409.
50 ml. of 0.75% Tide solution
50 ml. of 0.75% Dawn solution.

Method:

Four panels (of one type of material listed above) were treated separately with Tide, Dawn, 409 and Vinyl Siding Wash by dripping each cleaner onto a panel forming a small puddle. The samples were then allowed to dry completely at room temperature. Each panel was rinsed using normal pressure under flowing tap water in a sink for 1 minute. Samples were then held under normal fluorescent room lighting and examined for films. This procedure was repeated for remaining panels.

After rinsing, a brown-colored film was detected on the Tide-treated aluminum sample which could not be rinsed off. Tide also produced a heavy white film on the vinyl and glass samples that was removed by rinsing. The film left on Dawn-treated vinyl, glass and aluminum was easily rinsed off with water leaving no trace of residue but in the case of aluminum slight evidence of surface reactivity was evidenced by prolonged wetting of the surface. Formula 409 left a white film on the aluminum sample that could not be removed with rinsing. This product also produced a very faint clear film on glass that could not be removed with rinsing. The 409 film left on vinyl was completely rinsable. When dried, Vinyl Siding Wash was found to have left a film on all surface materials but in each instance this film was easily rinsed off.

EXAMPLE 4

This procedure tested the ability of the Vinyl Siding Wash Sprayer Apparatus to deliver enough product from a 24 oz. bottle of concentrate to cover a 500 square foot area adequately.

Test Equipment/Materials:

Two-story vinyl-sided house located in Charleston, S.C.
Green Garden Sprayer Apparatus.
50 ft. garden hose.
24-ounce bottle Vinyl Siding Wash Concentrate.

Method:

Using length and height measurements a 320-square foot area of one side of a large house was selected for treatment. A sprayer attachment with a known product-to-water ratio of 1:20 was then connected to a bottle containing 750 ml. (–25 oz.) of Vinyl Siding Wash concentrate. A hose was then attached to this apparatus and the measured area was treated with Vinyl Siding Wash. After rinsing, the amount of concentrate used was found by subtracting the remaining volume from the initial volume. It was determined that a 24 oz. bottle of concentrate can cover at least 500 $ft^2$.

EXAMPLE 5

This procedure tested the ability of the Vinyl Siding Wash Kit Sprayer to deliver a stream of water capable of reaching a vertical distance of 25 ft. In the instance the product is used to clean a large home, this feature becomes very important. The higher areas of a home's exterior require an effective and efficient water delivery system in order to clean vinyl siding to the proper degree.

Test Equipment/Materials:

Green Garden Sprayer Apparatus.
50 ft. garden hose.
Measuring Tape.

Method:

To record distances, a measuring tape was extended from the peak of a roof on the side of a one-story house downward until making contact with the ground. This distance was found to be 16 ft. Holding the sprayer at a height of 5 ft., water was sprayed upward. Using the tape measure as a reference, the water stream produced was observed to reach as high as the roof peak only (approximately 11 ft.).

The performance of the sprayer depends greatly upon water pressure which varies form home to home. Sprayer distance can therefore be expected to increase or decrease as a result. Other parameters include the spray pattern delivered by the apparatus itself and the sprayer's waterhole size. These physical aspects can affect sprayer performance as well.

The home selected for purposes of this test had average water pressure. With higher pressures, a greater distance such as up to 25 feet should be possible. The sprayer used in this test delivered a fanned spray pattern with a large diameter at relatively short distances which hampers the sprayers vertical reach. In addition, the water hole was small at approximately 0.125 inches in diameter which restricts flow.

EXAMPLE 6

An important characteristic of white and pastel-colored vinyl siding is their ability to chalk. Chalking is a term used to indirectly explain the ultraviolet (UV) degradation of vinyl siding. When exposed to direct sunlight, vinyl siding absorbs UV radiation. As a consequence, the PVC contained in the material is oxidized. The accompanying decrease in the molecular weight of this substance results in a water-soluble compound capable of being washed away by rain. Titanium dioxide pigment is then exposed as a white, chalk-like substance which can be collected simply by wiping the surface with bare hand. Chalking grade pigments are used intentionally by vinyl siding manufacturers because of this phenomenon. Chalking is viewed as an important self-renewing characteristic of vinyl siding. With each chalking cycle an outer layer is lost amounting to the loss of everything attached to that layer. Dirt and other contaminants are therefore swept away leaving a clean-looking surface. However, at best only 2 out of 4 sides of a home are exposed to the proper degree of UV radiation to allow for chalking. The remaining sides see no appreciable chalking taking place, if any at all.

Dirt and airborne contaminants therefore accumulate on these low-exposure areas. Because these areas are shaded, they also tend to remain moist (dew, rain, etc.) for extended periods of time. Higher humidity levels common to summer weather decrease the rate that moisture evaporates which further extends this contact of moisture to vinyl siding.

Typically, the low-UV side(s) of a house are the dirtiest. This is usually the north side (at least) and is commonly the area of a vinyl home's exterior where the above-mentioned process occurs (little chalking, shade, moisture) to the greatest extent. As a result, algae, mold and mildew, which being airborne spores, find the basic nutrients (dirt) and water (dew, rain) on vinyl siding required of most plant life to thrive. Once intimate contact with these necessary foods is established, the fungi begin a slow accumulation process. As humidity levels rise with atmospheric changes and air temperatures rise during summer months, these fungi are repeatedly dried and reinoculated generating layers of dead and live moisture-dependent organisms. Algae becomes green in color while mold and mildew are black. Vinyl Siding Wash is effective in removing these live/moist fungi easily.

With the approach of winter, lower humidity levels and falling temperatures occur. The fungi respond by entering a dormancy where growth is slowed and eventually stopped as moisture can no longer be retained in the amounts necessary for growth due to increasing evaporation rates. Algae, mold and mildew can become extremely difficult to remove under these conditions. In such cases, it may be necessary to apply two applications of Vinyl Siding Wash followed by a more powerful rinse using a regular hose spray nozzle in place of the Green Garden Sprayer apparatus. It should be noted that the hydrophobic nature of these dried growths, combined with the temperature and time requirements for reinoculation to occur, do not permit prior soaking of the fungi with water as a means of replacing lost moisture and revitalizing fungi to allow easier removal thereof.

The foregoing examples relate to a cleaning system effective on vinyl siding. Such siding is extremely hard and poses different cleaning problems than painted or stained outdoor surfaces which tend to be more porous due to the nature of the material beneath the paint (e.g., aged wood, porous brick or cement, etc.) and/or the nature of the paint (e.g., latex or oil base, presence of microfissures and/or cracks in the paint, etc.). The Vinyl Siding Wash was modified to provide effective cleaning of painted/stained outdoor surfaces by modifying the concentrated cleaning solution and changing the dilution ratio. In particular, the surfactant and silicate levels of the concentrated Vinyl Siding Wash were reduced and the concentrate was mixed with less water to provide a diluted cleaning solution with the same surfactant and silicate levels as in the diluted Vinyl Siding Wash but higher available chlorine and higher phosphate levels. The increased chlorine and phosphate levels can provide excellent cleaning results when the concentrated solution is diluted and applied to painted surfaces while maintaining long shelf life of the concentrated solution.

EXAMPLE 6

Using the modified Vinyl Siding Wash as described above, the following test procedure is a tabulated comparison of a variety of working dilutions of this product using a hose-end sprayer to achieve the targeted dilution ratios. It's purpose is to document a working dilution of concentrated product to establish a point at which this dilution becomes too great and thereby affect the overall performance of the product. The test was conducted on a heavily soiled house located in Charleston, S.C. The surface tested was painted wood (white) of uniform dirtiness. The results of this cleaning process are graded on a scale of 1 to 3, (1) representing the complete removal of associated soils, (2) representing partial removal of soils and, (3) representing no removal of soils whatsoever. The results of this comparative test are as follows:

| DILUTION RATIO | RESULT |
|---|---|
| 1:10 | 1 |
| 1:15 | 1 |
| 1:20 | 2 |
| 1:25 | 2.5 |

The results of the above test clearly define and establish an effective working range of dilutions for this particular product. A ratio of 1:10 is the preferred dilution because it lies well within a range of dilutions providing effective cleaning. The performance of this product begins to suffer as lower ratios are approached (eventually reaching a point where performance is non-existent). The porosity of a given painted wooden surface plays a role here. The particular soils targeted by this product tend to adhere more strongly to painted surfaces. Their tenacity therefore requires a more concentrated application of product to facilitate complete removal of the soil.

In the above example, the concentrated cleaning solution contained an active chlorine content of about 5%, sodium lauryl sulfate of about 1%, sodium metasilicate of about 0.125%, and TSP of about 1%. The concentrated cleaning solution was diluted with water by the amounts indicated, i.e., 1:10, 1:15, 1:20, and 1:25. The thus diluted cleaning solution was left on the painted surface for about 5–10 minutes and then rinsed off with a water rinse.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for cleaning material such as mold, mildew, algae, dirt and/or stains from a soiled outdoor painted or artificially stained surface selected from the group consisting of brick, concrete, wood and metal, comprising the steps of:

forming a diluted cleaning composition by feeding a concentrated cleaning composition from a container and water under pressure from a water hose into a mixing chamber of a spray gun attached to the container and the water hose, the concentrated cleaning composition consisting essentially of an aqueous chlorinated bleach solution and the concentrated cleaning composition having a hypochlorite content of about 3.0 to 10.0%;

spraying the diluted cleaning composition from the spray gun onto the soiled surface;

allowing the diluted cleaning composition to remain on the soiled surface for a period of time sufficient to loosen material to be removed from the soiled surface; and removing the loosened material together with the diluted cleaning composition from the soiled surface by spraying rinsing water onto the soiled surface.

2. The method of claim 1, wherein water is fed into the mixing chamber through a first inlet in the spray gun, the diluted cleaning composition is fed into the mixing chamber through a second inlet in the spray gun and the diluted cleaning composition and/or the rinsing water are sprayed from the spray gun through at least one outlet in the spray gun.

3. The method of claim 1, wherein the at least one outlet comprises first and second outlets, the diluted cleaning composition being sprayed only from the first outlet and the rinsing water being sprayed only from the second outlet.

4. The method of claim 1, wherein the concentrated cleaning composition is alcohol-free and further comprises a surfactant in an mount of 0.10 to 2.5% for wetting of the soiled surface, penetration into the soil and minimize destabilization of available chlorine in the bleach solution, a phosphate in an amount of 0.5 to 5.0% for stabilizing the available chlorine in the bleach solution by maintaining the pH of the bleach solution at a level which retards oxidation of the available chlorine, and a silicate in an mount of 0.05 to 0.25% for protecting metal and/or glass surfaces which come into contact with the cleaning composition, the concentrated cleaning solution being diluted during the step of forming the diluted cleaning composition so that the diluted cleaning composition has a hypochlorite content of about 0.10 to about 2.0%, a phosphate in an mount of effective for water softening, a surfactant in an amount effective for wetting of the soiled surface and penetration into the soil, the surfactant being present in an mount of less than 0.5%, and a silicate in an mount of 0.005 to 0.05% for protecting metal and/or glass surfaces which come into contact with the cleaning composition.

5. The method of claim 1, wherein the diluted cleaning composition is sprayed from the spray gun in a first pattern and the rinsing water is sprayed from the spray Sun in a second pattern, the second pattern being smaller than the first pattern.

6. The method of claim 1, wherein the velocity of the water in the rinsing step is from about five meters per second to about 30 meters per second and the volume of water applied to the soiled surface in the rinsing step is from about 1 to about 10 liters per square meter of soiled surface.

7. A method for cleaning materials such as mold, mildew, algae, dirt and/or stains from a soiled outdoor painted or artificially stained surface selected from the group consisting of brick, concrete, wood and metal, comprising the steps of:

forming a diluted cleaning composition by feeding a concentrated cleaning composition from a container and water under pressure from a water hose into a mixing chamber of a spray gun attached to the container and the water hose, the concentrated cleaning composition consisting essentially of an aqueous chlorinated bleach solution, the concentrated cleaning composition having a hypochlorite content of about 3.0 to 10.0% and a silicate in an mount sufficient for protecting metal and/or glass surfaces which come into contact with the cleaning composition;

spraying the diluted cleaning composition from the spray gun onto the soiled surface;

allowing the diluted cleaning composition to remain on the soiled surface for a period of time sufficient to loosen material to be removed from the soiled surface; and removing the loosened material together with the diluted cleaning composition from the soiled surface by spraying rinsing water onto the soiled surface.

8. The method of claim 7, wherein the concentrated cleaning composition is diluted by an mount of up to 20 times during the step of forming the diluted cleaning composition.

9. The method of claim 7, wherein the concentrated cleaning composition further comprises an anionic surfactant in an amount of 0.25 to 5.0%.

10. The method of claim 7, wherein the concentrated cleaning composition comprises at least 90% water and 0.1 to 0.5% of the silicate.

11. A method for cleaning materials such as mold, mildew, algae, dirt and/or stains from a soiled outdoor painted or artificially stained surface selected from the group consisting of brick, concrete, wood and metal, comprising the steps of:

forming a diluted cleaning composition by feeding a concentrated cleaning composition from a container and water under pressure from a water hose into a mixing chamber of a spray gun attached to the container and the water hose, the concentrated cleaning composition consisting essentially of an aqueous chlorinated bleach solution, the concentrated cleaning composition having a hypochlorite content of about 3.0 to 10.0% and includes a phosphate in an amount sufficient for stabilizing available chlorine in the bleach solution by maintaining the pH of the bleach solution at a level which retards oxidation of the available chlorine;

spraying the diluted cleaning composition from the spray gun onto the soiled surface;

allowing the diluted cleaning composition to remain on the soiled surface for a period of time sufficient to loosen material to be removed from the soiled surface; and removing the loosened material together with the diluted cleaning composition from the soiled surface by spraying rinsing water onto the soiled surface.

12. The method of claim 11, wherein the concentrated cleaning composition is diluted by an amount of up to 20 times during the step of forming the diluted cleaning composition.

13. The method of claim 11, wherein the concentrated cleaning composition further comprises an anionic surfactant in an amount of 0.10 to 2.5%.

14. The method of claim 11, wherein the concentrated cleaning composition comprises at least 90% water and 0.5 to 5.0% of the phosphate.

15. A method for cleaning materials such as mold, mildew, algae, dirt and/or stains from a soiled outdoor painted or artifically stained surface selected from the group consisting of brick, concrete, wood and metal, comprising the steps of:

forming a diluted cleaning composition by feeding a concentrated cleaning composition from a container and water under pressure from a water hose into a mixing chamber of a spray gun attached to the container and the water hose, the concentrated cleaning composition consisting essentially of an aqueous chlorinated bleach solution, the concentrated cleaning composition having a hypochlorite content of about 3.0 to 10.0% and including a surfactant in an mount sufficient for wetting of the soiled surface, penetration into soil and minimizing destabilization of available chlorine in the bleach solution;

spraying the diluted cleaning composition from the spray gun onto the soiled surface;

allowing the diluted cleaning composition to remain on the soiled surface for a period of time sufficient to loosen material to be removed from the soiled surface; and removing the loosened material together with the diluted cleaning composition from the soiled surface by spraying rinsing water onto the soiled surface.

16. The method of claim 15, wherein the concentrated cleaning composition is diluted by an amount of up to 20 times during the step of forming the diluted cleaning composition and the surfactant is an anionic surfactant.

17. The method of claim 15, wherein the concentrated cleaning composition comprises at least 90% water and 0.10 to 2.5% of the surfactant.

* * * * *